US005977859A

United States Patent [19]

Kawamura et al.

[11] Patent Number: 5,977,859

[45] Date of Patent: Nov. 2, 1999

[54] MULTIELECTRODE TYPE FUSE ELEMENT AND MULTIELECTRODE TYPE FUSE USING THE SAME

[75] Inventors: Isao Kawamura, Ogaki; Iwao Murakami; Isato Kataoka, both of Gifu-ken, all of Japan

[73] Assignee: Pacific Engineering Company, Japan

[21] Appl. No.: 09/104,430

[22] Filed: Jun. 25, 1998

[51] Int. Cl.[6] ..... H01H 85/56; H01H 85/08; H01H 69/02

[52] U.S. Cl. ..... 337/295; 337/290; 337/255; 29/623

[58] Field of Search ..... 337/295, 255, 337/264, 290, 161, 164, 189, 229, 293; 29/623

[56] References Cited

U.S. PATENT DOCUMENTS

| | | | |
|---|---|---|---|
| 4,023,264 | 5/1977 | Schmidt, Jr. et al. . | |
| 4,023,265 | 5/1977 | Aryamane . | |
| 4,604,602 | 8/1986 | Borzoni | 337/264 |
| 4,689,597 | 8/1987 | Galloway et al. | 337/186 |
| 4,831,353 | 5/1989 | Gaia et al. | 337/255 |
| 5,229,739 | 7/1993 | Oh et al. . | |
| 5,373,278 | 12/1994 | Saulgeot et al. | 337/255 |
| 5,629,664 | 5/1997 | Muramatsu et al. | 337/261 |
| 5,886,611 | 3/1999 | Schaller et al. | 337/189 |

FOREIGN PATENT DOCUMENTS

| | | |
|---|---|---|
| 0 802 553 A2 | 10/1997 | European Pat. Off. . |
| 0 829 928 A2 | 3/1998 | European Pat. Off. . |
| 30 44040A1 | 7/1982 | Germany . |
| 51-18946 | 2/1976 | Japan . |
| 52-86148 | 7/1977 | Japan . |
| 57-17049 | 1/1982 | Japan . |
| 58-27966 | 2/1983 | Japan . |
| 61-14625 | 4/1986 | Japan . |
| 62-31466 | 7/1987 | Japan . |
| 03285230 | 12/1991 | Japan . |
| 07105826 | 4/1995 | Japan . |

*Primary Examiner*—Leo P. Picard
*Assistant Examiner*—Anatoly Vortman
*Attorney, Agent, or Firm*—Nixon & Vanderhye

[57] ABSTRACT

A multielectrode type fuse element manufactured by forming a shallow shaving portion 1 of a definite width in the long fuse material 9 in a longitudinal direction so as to form a thin area 2, punching from portions of the thin area 2 dependently on electrical conduction capacities of fuses so as to form a plurality of blowout portions 3, 3, forming a hook-like extending portion 6 on one side across the thin area 2 at an upper end of an input terminal 4 disposed in a direction perpendicular to the longitudinal direction of the long fuse material 9, forming a plurality of output terminals 5, 5 by punching from the long fuse material on a side of the hook-like extending portion 6 of the input terminal 4 in parallel with the input terminal 4 at an equal pitch, and forming the blowout portions 3, 3 to connect one side of an upper portion of a vertical section of the input terminal 4 and a lower tip of the hook-like extending portion 6 with top end of the plurality of output terminals 5, 5.

4 Claims, 7 Drawing Sheets

MULTIELECTRODE TYPE FUSE ELEMENT AND MULTIELECTRODE TYPE FUSE USING THE SAME

BACKGROUND OF THE INVENTION

1. Field of the Invention

The present invention relates to a blade type multielectrode fuse to be used mainly for automobiles which is characterized in that blowout portions and a plurality of terminals are formed integrally by punching from a long fuse material consisting of a single electrically conductive plate.

2. Description of the Related Art

A fuse element which is disclosed by U.S. Pat. No. 4023264 is conventionally known as a general fuse which is to be disposed in a fuse box for automobiles.

This fuse element is manufactured by sequentially punching with presses and cutting out from a long fuse material 12 which has a thin portion 11 of definite width formed at in a longitudinal direction at a middle portion thereof into a piece having a predetermined shape and a predetermined length, and configured as a bielectrode type fuse element which has a thin blowout portion 13 between a pair of right and left terminals as shown in FIGS. 7 and 8. In addition, a reference numeral 10 represents an insulating housing in which the fuse element is to be disposed and fixed.

Further, a fuse element disclosed by Japanese Patent Publication (KOKOKU) No. 61-14625 is known as a multielectrode type fuse element which is configured to prevent a blown fuse from influencing on other fuses by arranging a plurality of output terminals in parallel with an input terminal on a side of a power source by way of a blowout portion.

This fuse element is manufactured by punching from a long fuse metal plate material 14, and consists of a common link 16 and a plurality of fuse forming links 17, 17, . . . which are disposed on one side of a coupling link 15 so that they hang down in parallel with one another, and that they have blowout portions 18 which have sectional areas smaller than those of the other portions as shown in FIGS. 9 and 10.

The multielectrode type fuse element described above is manufactured by punching from the fuse metal plate 14 which has a definite thickness and projecting a portion 19 from the common link 16, and the links hang down in parallel with one another on one side of (under) the coupling link 15.

Though the fuse element disclosed by U.S. Pat. No. 4,023,264 can be manufactured efficiently in a large number by sequentially punching with presses from a long fuse material and cutting into a piece having a predetermined shape and a predetermined length while feeding the long fuse material 12 which has the longitudinal thin area 11 of the definite width in the middle portion thereof, this fuse element is required in a large number for a single vehicle since the fuse element is configured to control electric conduction capacity between an input terminal and output terminals.

Further, the multielectrode type fuse element disclosed by Japanese Patent Publication (KOKOKU) No. 61-14625 is limited from a viewpoint of working in its width to be pouched since the blowout portions 18 are formed by punching from the fuse metal plate 14 having the definite thickness.

Since it is required to reduce sectional areas of the blowout portion 18 dependently on electrical conduction capacities, these sectional areas can be adjusted only within a certain limited range by adjusting only a punching width from a plate-like metal which has a definite thickness (0.65 mm) required for the fuse links.

In the blade type fuses which utilize fuse links and are widely used for various kinds of vehicles, the fuse links are 0.65 mm thick and the blowout portions have an sectional area of 0.3 $mm^2$ for 30A (amperes) or 0.1 $mm^2$ for 1 A: these blowout portions having sizes from 0.3 mm thick by 1.0 mm wide to 0.1 mm thick by 0.1 mm wide.

Accordingly, these blade type fuse elements having the blowout portions with a small sectional area cannot be manufactured, like the multielectrode type fuse element disclosed by Japanese Patent Publication (KOKOKU) No. 61-14625, only by adjusting a punching width from the plate-like metal 0.65 mm thick.

SUMMARY OF THE INVENTION

The present invention has solved the conventional problems described above and characterized in that it allows to blowout portions to be punched in a large width and facilitates to adjust a sectional areas of the blowout portions by forming, prior to manufacturing a multielectrode type fuse element by punching from a long fuse material consisting of an electrically conductive plate, a thin area which has a definite width dependently on electric conduction capacities of fuses at a predetermined location of the long fuse material in a longitudinal direction by a shaving work and then by punching a piece having a predetermined shape from the long fuse material in a process to transfer the long fuse material.

A first subject of present invention provides a multielectrode type fuse element which is characterized in that it has a configuration wherein a thin area 2 is formed by forming a shallow shaving portion 1 having a definite width by cutting at a predetermined location of a long fuse material 9 consisting of an electrically conductive plate in a longitudinal direction, a plurality of blowout portions 3, 3 are formed in a predetermined width by sequentially punching from portions of said thin area 2 dependently on electrical conduction capacity of a fuse and other portions are concurrently punched in a predetermined shape, a hook-like extending portion 6 is formed on one side across said thin area 2 at an upper end of an input terminal 4 disposed in a direction perpendicular to the longitudinal direction of said long fuse material 9, a plurality of output terminals 5, 5 are formed on a side of said hook-like extending portion 6 of said input terminal 4 in parallel with said input terminal 4 at an equal pitch, and the blowout portions 3, 3 are formed to connect one side of an upper portion of a vertical section of said input terminal 4 and lower tip of said hook-like portion 6 with top ends of said plurality of output terminals 5, 5.

A second subject of present invention provides a multielectrode type fuse element which is characterized in that it has a configuration wherein a thin area 2 is formed by forming a shallow shaving portion 1 having a definite width by cutting at a predetermined location of a long fuse material 9 consisting of an electrically conductive plate in a longitudinal direction, a plurality of blowout portions 3, 3 are formed in a predetermined width by sequentially punching from portions of said thin area 2 dependently on electrically conduction capacities of fuses and other portions are concurrently punched in a predetermined shape, a T-shaped extending portion 6' is formed across said thin area 2 at an upper end of an input terminal 4 which is disposed in a direction perpendicular to the longitudinal direction of said long fuse material 9, a plurality of output terminals 5, 5 are formed on both sides of said input terminal 4 in parallel with said input terminal 4 at an equal pitch, and the blowout portions 3, 3 are formed to connect both sides of an upper portion of a vertical section of said input terminal 4 and lower tips of both sides of the T-shaped extending portion 6' with top ends of both sides of said plurality of output terminals 5, 5.

A third subject of present invention provides a multielectrode type fuse which consists of the multielectrode type fuse element according to the second invention whose upper half is disposed and fixed in an insulating housing 10.

A fourth subject of present invention provides a multielectrode type fuse which consists of a pair of the multielectrode type fuse elements according to the first invention whose upper halves are disposed and fixed in an insulating housing 10 in a condition where the input terminals 4, 4 are disposed adjacent to each other.

Further objects and advantages of the present invention will be apparent from the following description of the preferred embodiments of the invention as illustrated in the accompanying drawings.

DESCRIPTION OF THE PREFERRED EMBODIMENTS

Figure 1:
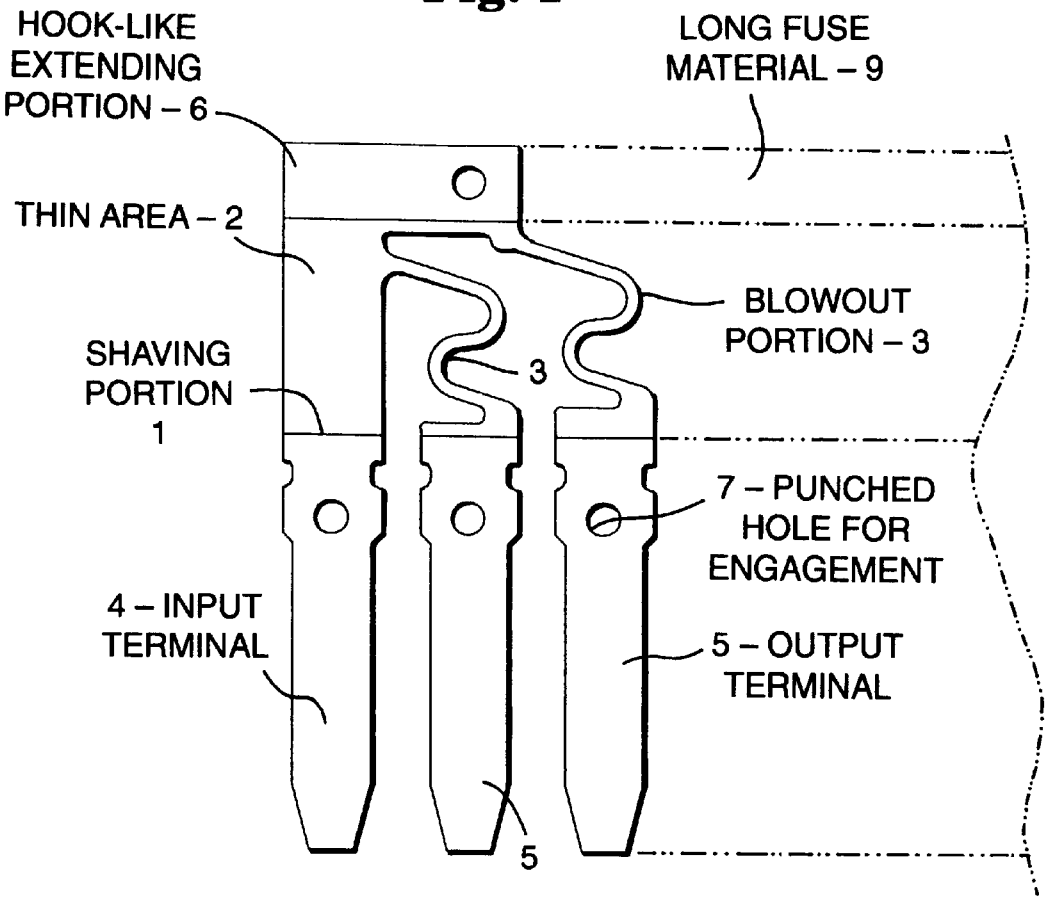
FIG. 1 is a front view illustrating an embodiment of the multielectrode type fuse element according to the present invention.

Now, an embodiment of the present invention will be described with reference to FIGS. 1 and 2.

In the drawing, a reference numeral 9 represents a long fuse material which consists of an electrically conductive plate and on which a thin area 2 having a definite width is formed in a longitudinal direction at a location a little shifted upward from a center in a width direction with shallow shaving portions 1 formed by cutting both surfaces.

Figure 2:
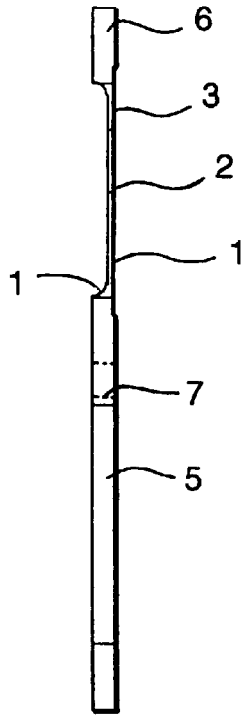
FIG. 2 is a side view illustrating the multielectrocie type fuse element shown in FIG. 1.

This thin area 2 may be provided by cutting both front and rear surfaces so as to form the shallow shaving portions 1, 1 as shown in FIG. 2 or one surface only, and a thickness of the thin are 2 is determined in association with a punching width of a blowout portion 3 dependently on electrical conduction capacities of fuses.

The multielectrode type fuse element according to the present invention is punched sequentially, as shown in FIG. 1, with presses in a process to transfer the long fuse material 9 so that the fuse element has a configuration wherein a hook-like extending portion 6 is formed on one side (right side) across the thin area 2 at an upper end of an input terminal 4 which is disposed in a direction perpendicular to the longitudinal direction of the long fuse material 9 and blowout portions 3, 3 are formed to connect one side (right side) of an upper portion of a vertical section of the input terminal 4 and a lower tip of the hook-like extending portion 6 with top ends of a plurality of output terminals 5, 5 which are arranged in parallel with the input terminal 4 at an equal pitch.

In the multielectrode type fuse element which is punched as described above, the blowout portions 3, 3 are positioned so as to be located on the thin area 2.

In the drawings, a reference numeral 7 represent a punched hole which is to be used for engagement at a stage to insert the multielectrode type fuse element into an insulating housing and caulk it.

By sequentially repeating the punching step described above in a transferring process of the long fuse material 9, it is possible to obtain efficiently and in a short time a large number of multielectrode type fuse elements in each of which the input terminal 4 and the plurality of output terminals 5, 5 are arranged at a constant pitch in the direction perpendicular to the longitudinal direction of the long fuse material 9.

Figure 3:
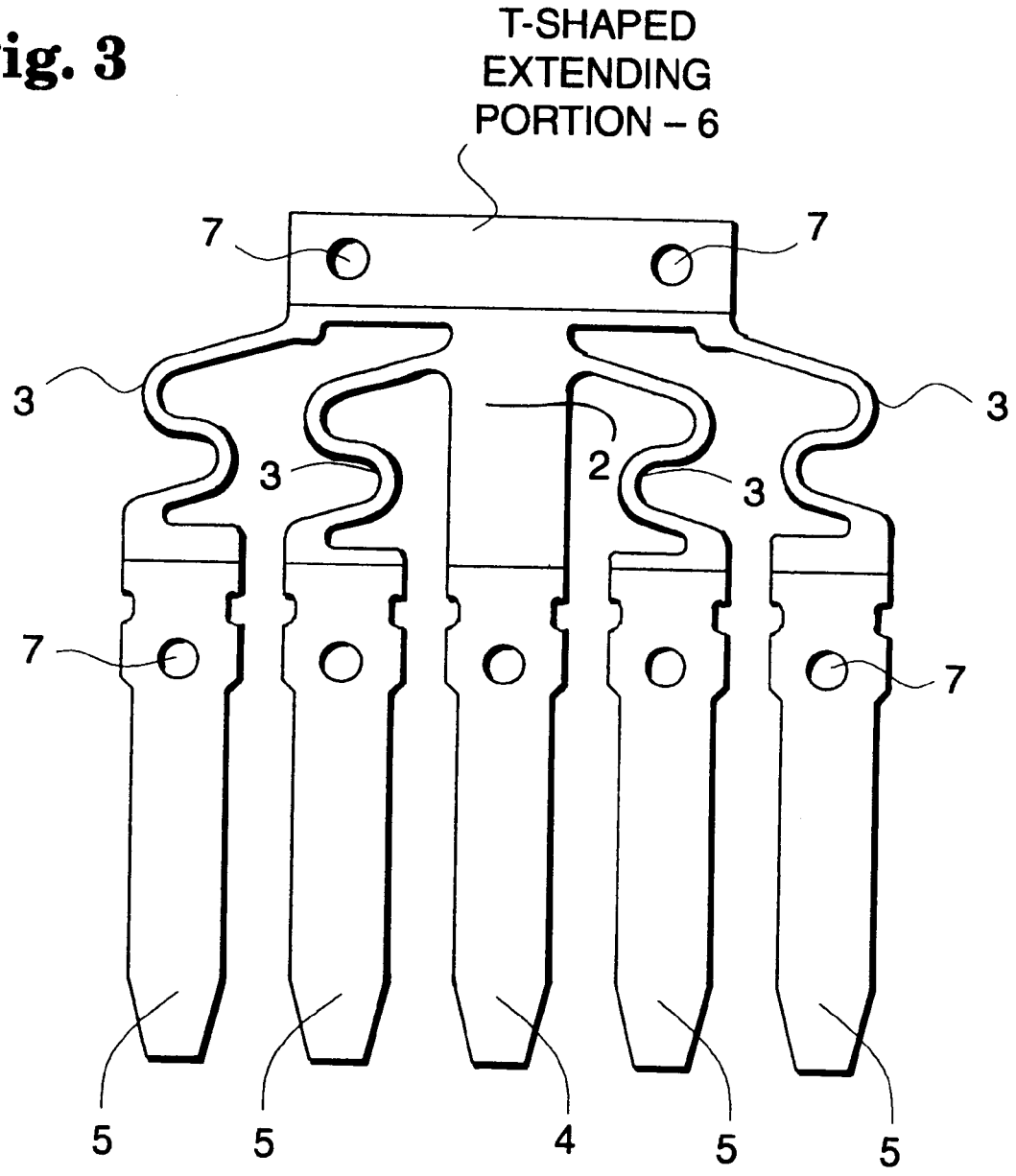
FIG. 3 is a front view illustrating another embodiment of the multielectrode type fuse element according to the present invention.

FIG. 3 shows a fuse element in which output terminals 5, 5 of the fuse element having the shape shown in FIG. 1 are arranged also on a left side of an input terminal 4 symmetrically and integrally. It is possible to sequentially punch fuse elements having this shape with presses in the process to transfer the long fuse material 9.

In this embodiment, a T-shaped extending portion 6' is formed at an upper end of the input terminal 4 located at the center across the thin area 2, and the plurality of output terminals 5, 5 which are arranged on the right and left sides of the input terminal 4 and the input terminal 4 are formed in parallel with one another at a constant pitch, and blowout portions 3, 3 are formed to connect both sides of an upper portion of a vertical section of the input terminal 4 and lower tips on both sides of the T-shaped extending portion 6' with top ends of the plurality of output terminals 5, 5 on both sides.

Figure 4:
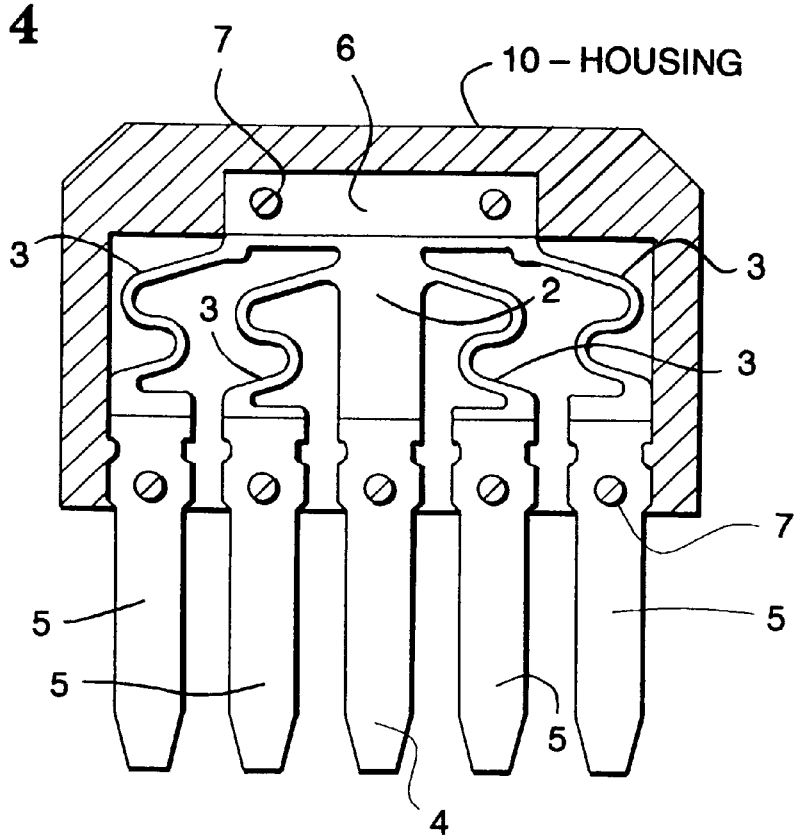
FIG. 4 is a front view illustrating a longitudinal section of the fuse element shown in FIG. 3 in a condition where it is disposed in a housing.
Figure 5:
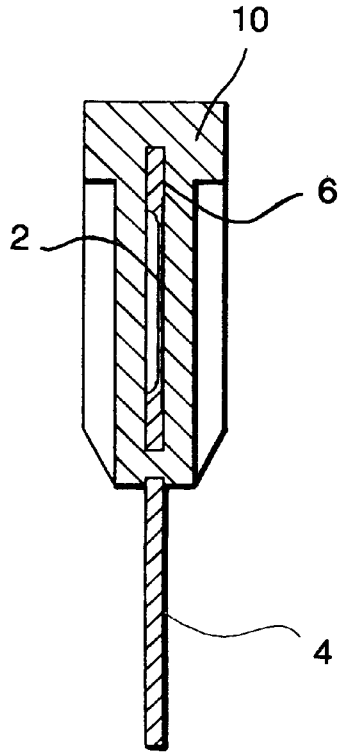
FIG. 5 is a side view illustrating a longitudinal section of a middle portion of the fuse element shown in FIG. 4.

FIGS. 4 and 5 are a front view of a longitudinal section illustrating a condition where the upper half of the fuse element having the shape shown in FIG. 3 is disposed and fixed in an insulating housing 10, and a side view of a longitudinal section of the middle part or a condition where the multielectrode type fuse is actually used.

Figure 6:
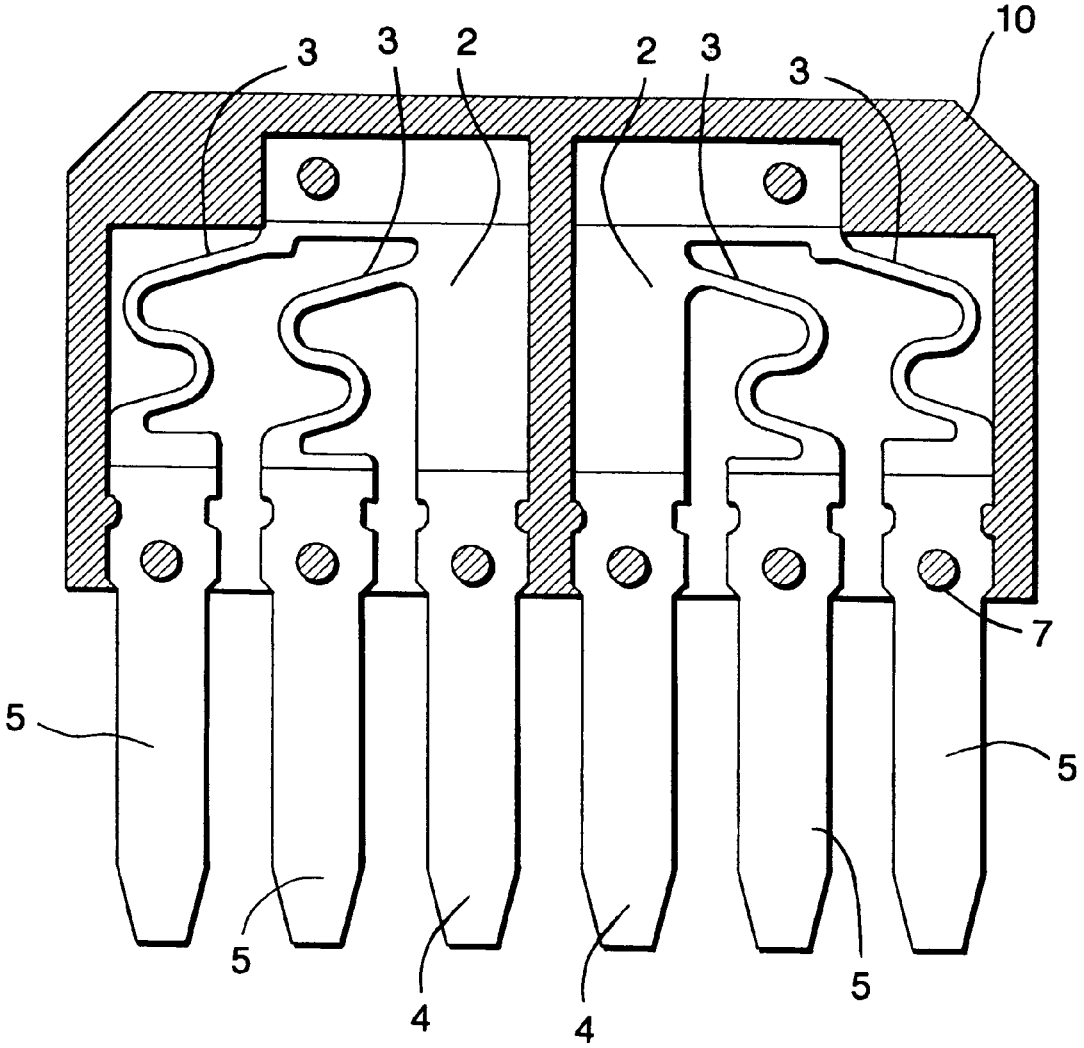
FIG. 6 is a front view illustrating a longitudinal section of a pair of fuse elements shown in FIG. 1 in a condition where they are disposed in a housing.
Figure 7:
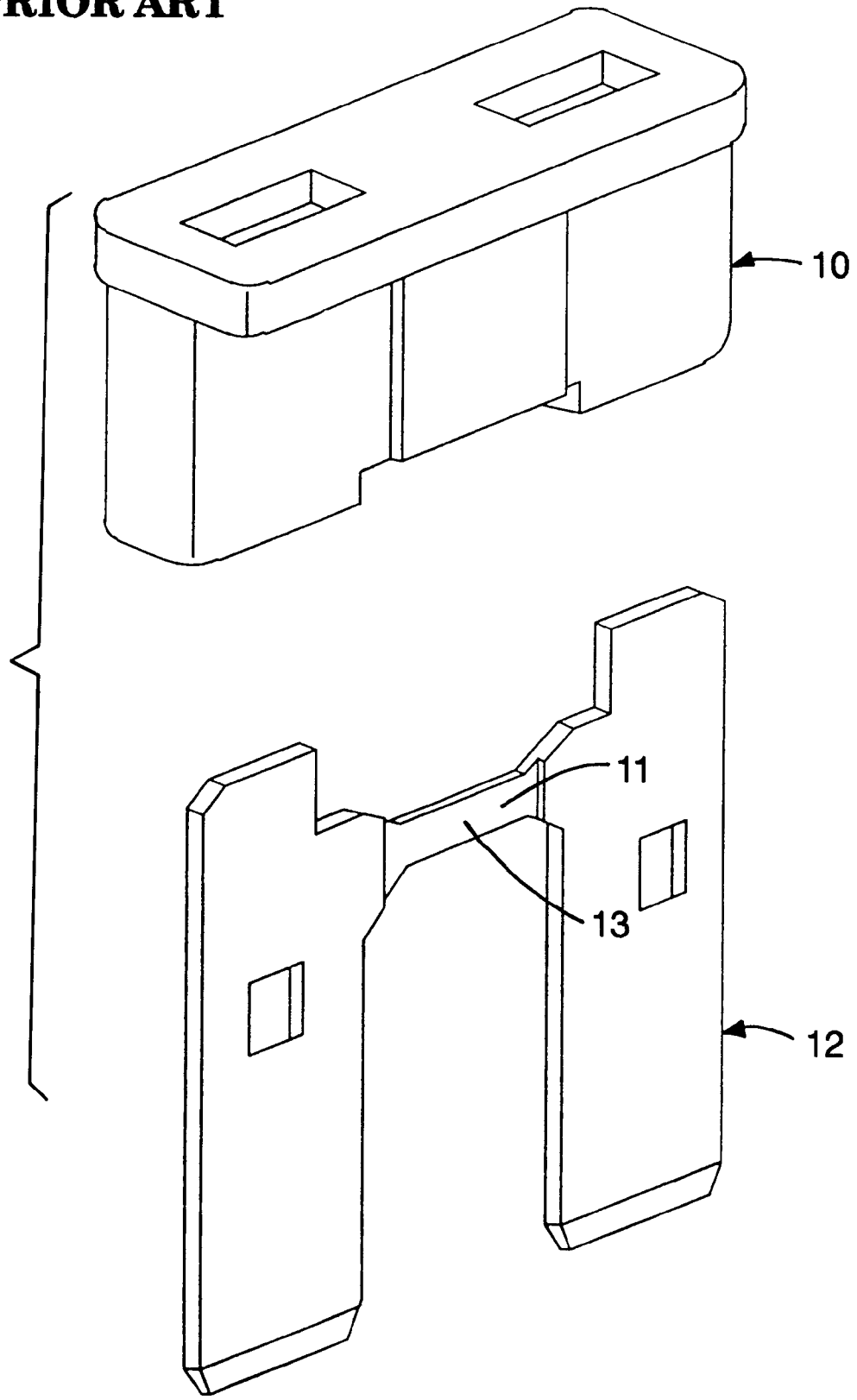
Fig. 7 PRIOR ART
FIG. 7 is an exploded perspective view illustrating a conventional bielectrode type fuse element.
Figure 8:
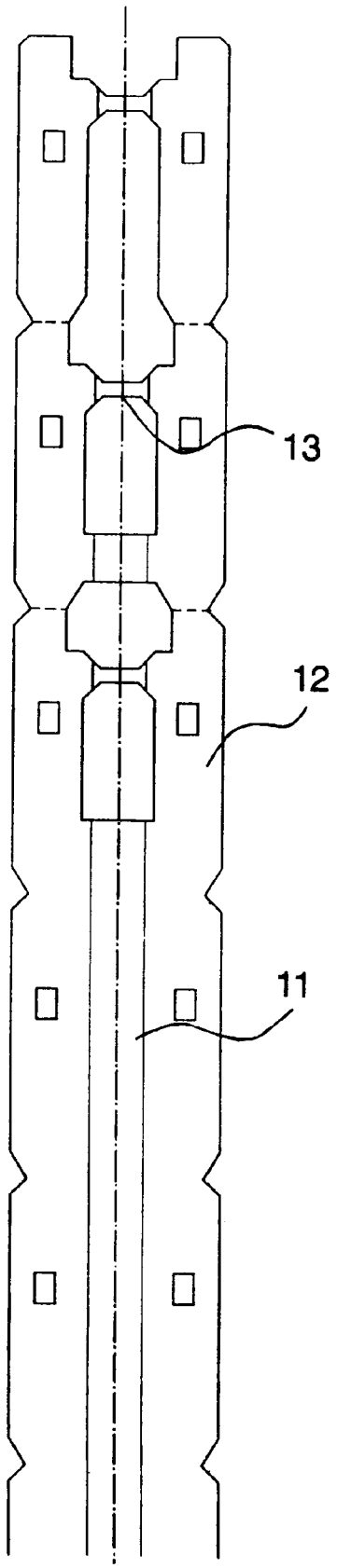
Fig. 8 PRIOR ART
FIG. 8 is a front view illustrating a punched out material for the fuse element shown in FIG. 7.
Figure 9:
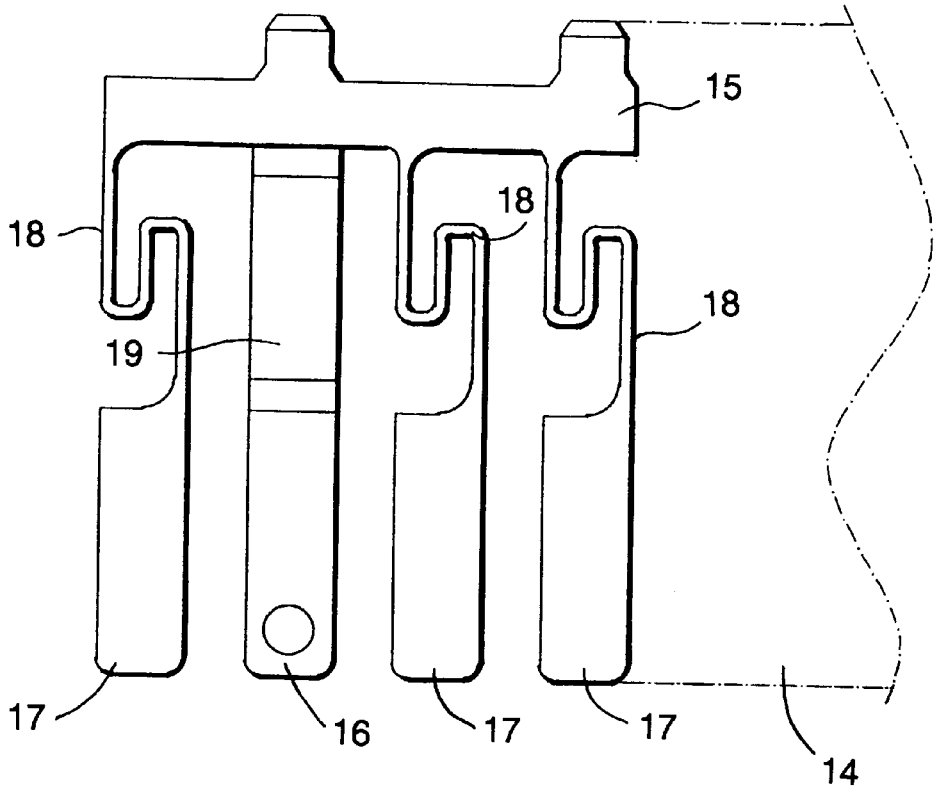
Fig. 9 PRIOR ART
FIG. 9 is a front view illustrating a conventional multielectrode type fuse element.
Figure 10:
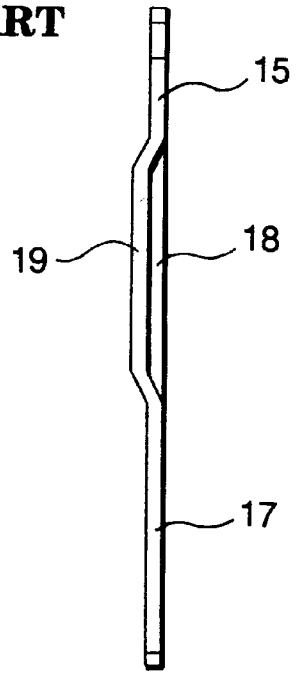
Fig. 10 PRIOR ART
FIG. 10 is a side view illustrating the multielectrode type fuse element shown in FIG. 9.

FIG. 6 is a front view of a longitudinal section illustrating a condition where the upper half of two fuse elements which have the shape shown in FIG. 1 is disposed and fixed in an insulating housing 10 with the input terminals 4, 4 adjacent to each other.

The multielectrode type fuse element according to the present invention can easily be manufactured simply by punching and cutting in a predetermined shape from the long fuse material since the thin area 2 having the definite width can be preliminarily formed over an entire length of the long fuse material in the longitudinal direction thereof.

Further, the multielectrode type fuse element according to the present invention in which the thin area is preliminarily formed as blowout portions can be punched so as to have a large width, thereby facilitating to adjust a sectional area of the blowout portion and enhancing design freedom.

Furthermore, the multielectrode type fuse element according to the present invention in which a plurality of output terminals are equipped with blowout portions respectively has fuse functions for a plurality of circuits, thereby making it possible to configure a set of fuses as a whole more compact and lighter in weight.

Accordingly, the multielectrode type fuse element according to the present invention makes it possible to configure a fuse box more compact and lighter in weight, and features high industrial utility.

Many widely different embodiments of the present invention may be constructed without departing from the spirit and scope of the present invention. It should be understood that the present invention is not limited to the specific embodiments described in the specification, except as defined in the appended claims.

What is claimed is:

1. A multielectrode type fuse element, wherein a thin area 2 is formed by forming a shallow shaving portion 1 having a definite width by cutting at a predetermined location of a long fuse material 9 consisting of an electrically conductive plate in a longitudinal direction, a plurality of blowout portions 3, 3 are formed in a predetermined width by sequentially punching from portions of said thin area 2 dependently on electrical conduction capacity of a fuse and other portions are concurrently punched in a predetermined shape, a hook-like extending portion 6 is formed on one side across said thin area 2 at an upper end of an input terminal 4 disposed in a direction perpendicular to the longitudinal direction of said long fuse material 9, a plurality of output terminals 5, 5 are formed on a side of said hook-like extending portion 6 of said input terminal 4 in parallel with said input terminal 4 at an equal pitch, and the blowout portions 3, 3 are formed to connect one side of an upper portion of a vertical section of said input terminal 4 and lower tip of said hook-like portion 6 with top ends of said plurality of output terminals 5, 5.

2. A multielectrode type fuse element, wherein a thin area 2 is formed by forming a shallow shaving portion 1 having a definite width by cutting at a predetermined location of a long fuse material 9 consisting of an electrically conductive plate in a longitudinal direction, a plurality of blowout portions 3, 3 are formed in a predetermined width by sequentially punching from portions of said thin area 2 dependently on electrically conduction capacities of fuses and other portions are concurrently punched in a predetermined shape, a T-shaped extending portion 6' is formed across said thin area 2 at an upper end of an input terminal 4 which is disposed in a direction perpendicular to the longitudinal direction of said long fuse material 9, a plurality of output terminals 5, 5 are formed on both sides of said input terminal 4 in parallel with said input terminal 4 at an equal pitch, and the blowout portions 3, 3 are formed to connect both sides of an upper portion of a vertical section of said input terminal 4 and lower tips of both sides of the T-shaped extending portion 6' with top ends of both sides of said plurality of output terminals 5, 5.

3. A multielectrode type fuse as claimed in claim 2, wherein an upper half of the multielectrode type fuse element is disposed and fixed in an insulating housing 10.

4. A multielectrode type fuse as claimed in claim 1, wherein upper halves of a pair of the multielectrode type fuse elements are disposed and fixed in an insulating housing 10 in a condition where the input terminals 4, 4 are disposed adjacent to each other.

* * * * *

UNITED STATES PATENT AND TRADEMARK OFFICE

CERTIFICATE OF CORRECTION

PATENT NO. : 5,977,859
DATED : November 2, 1999
INVENTOR(S) : KAWAMURA et al

It is certified that error appears in the above-identified patent and that said letters patent is hereby corrected as shown below:

On the title page, column 1, item [73 Assignee] should read --Pacific Engineering Corporation--.

Signed and Sealed this

First Day of August, 2000

*Attest:*

Q. TODD DICKINSON

*Attesting Officer*

*Director of Patents and Trademarks*